US011234297B2

(12) United States Patent
Kim

(10) Patent No.: US 11,234,297 B2
(45) Date of Patent: Jan. 25, 2022

(54) PLATE HEATER

(71) Applicant: CHARMGRAPHENE CO., LTD., Suwon-si (KR)

(72) Inventor: Yong-Ki Kim, Hwaseong-si (KR)

(73) Assignee: CHARMGRAPHENE CO., LTD., Suwon-si (KR)

( * ) Notice: Subject to any disclaimer, the term of this patent is extended or adjusted under 35 U.S.C. 154(b) by 383 days.

(21) Appl. No.: 16/170,876

(22) Filed: Oct. 25, 2018

(65) Prior Publication Data

US 2019/0268975 A1 Aug. 29, 2019

(30) Foreign Application Priority Data

Feb. 26, 2018 (KR) ..... 10-2018-0023127
Feb. 26, 2018 (KR) ..... 10-2018-0023176

(51) Int. Cl.

| | |
|---|---|
| ***H05B 3/14*** | (2006.01) |
| ***H05B 3/03*** | (2006.01) |
| ***H05B 3/84*** | (2006.01) |
| ***H05B 3/26*** | (2006.01) |
| ***H05B 3/16*** | (2006.01) |

(52) U.S. Cl.

CPC ..... *H05B 3/145* (2013.01); *H05B 3/03* (2013.01); *H05B 3/16* (2013.01); *H05B 3/26* (2013.01); *H05B 3/84* (2013.01)

(58) Field of Classification Search

CPC . H05B 3/145; H05B 3/03; H05B 3/84; H05B 3/26; H05B 3/16; H05B 3/845; H05B 2214/04; H05B 2214/02; H05B 2203/006; H05B 2203/002

See application file for complete search history.

(56) References Cited

U.S. PATENT DOCUMENTS

2004/0149734 A1* 8/2004 Petrenko ..... B60S 1/026 219/538

FOREIGN PATENT DOCUMENTS

| | | | |
|---|---|---|---|
| CN | 202334949 | U | 7/2012 |
| CN | 102655693 | A | 9/2012 |
| CN | 104869676 | A | 8/2015 |
| JP | H 07-014668 | A | 1/1995 |

(Continued)

OTHER PUBLICATIONS

Korean Office Action dated Mar. 21, 2019, issued to Korean Application No. 10-2018-0023127.

(Continued)

*Primary Examiner* — Shawntina T Fuqua
(74) *Attorney, Agent, or Firm* — Stein IP, LLC

(57) ABSTRACT

Disclosed herein is a plane heater that generates heat by using graphene or the like as the conductive heat generation material thereof. The plane heater includes: a nonconductor substrate; a heat generation material applied to the nonconductor substrate; and a pair of electrodes configured to generate resistance heat in the heat generation material. The pair of electrodes include a first electrode configured to be connected to one pole of a power source, and a second electrode configured to be connected to the other pole of the power source. The sectional areas of at least some portions of the first electrode and the second electrode are determined such that a plurality of electric circuits formed by the first electrode, the heat generation material, and the second electrode can have the theoretically same resistance.

5 Claims, 15 Drawing Sheets

(56) References Cited

FOREIGN PATENT DOCUMENTS

| | | | |
|---|---|---|---|
| JP | 2002-313540 | A | 10/2002 |
| JP | 2007-280788 | A | 10/2007 |
| JP | 2007-299546 | A | 11/2007 |
| KR | 10-2015-0033290 | A | 4/2015 |

OTHER PUBLICATIONS

Korean Office Action dated Mar. 29, 2019, issued to Korean Application No. 10-2018-0023176.
Korean Office Action dated Jan. 28, 2021, issued to Korean Application No. 10-2019-0083933.
Korean Office Action dated Jan. 28, 2021, issued to Korean Application No. 10-2019-0084145.
Chinese Office Action dated Mar. 26, 2021, issued to Chinese Application No. 201811258215.8.

* cited by examiner (a)

(b)

(a)

(b)

PLATE HEATER

CROSS-REFERENCE TO RELATED APPLICATION

This application claims the benefit of Korean Patent Application Nos. 10-2018-0023127 filed on Feb. 26, 2018 and 10-2018-0023176 filed on Feb. 26, 2018, which is hereby incorporated by reference herein in its entirety.

BACKGROUND

1. Technical Field

The present invention relates to a plane heater in which graphene or the like is used as the conductive heat generation material thereof.

2. Description of the Related Art

In general, plane heaters may be applied to the glass surfaces of freezing display cases, window systems, the glass surfaces or sheets of automobiles, the mirrors of bathrooms, electric rice cookers, etc.

Such a plane heater is generally configured such that a conductive heat generation material, such as graphene or the like, is applied to a nonconductive substrate and, for example, a first electrode, i.e., a positive electrode, and a second electrode, i.e., a negative electrode, are coupled to the conductive heat generation material. Then, when a direct or alternating current voltage is applied to the first electrode and the second electrode, current flows across the conductive heating material and thus resistance heat is generated.

However, in conventional plane heaters, local overheating occurs at power input points due to large amounts of current at the power input points, and relatively low heat generation occurs in portions far from the power input points. Accordingly, a problem arises in that heat generation is not uniform throughout the plane heaters. Therefore, it is difficult to apply the conventional plane heaters to devices requiring uniform heating.

[Prior Art Document]

[Patent Document]

Korean Patent Application Publication No. 10-2015-0033290

SUMMARY

The present invention has been conceived to overcome the above-described problems of the prior art, and an object of the present invention is to provide technology that enables resistance to be uniform throughout all electric circuits including both electrodes and heat generation material.

According to a first aspect of the present invention, there is provided a plane heater including: a nonconductor substrate; a heat generation material applied to the nonconductor substrate; and a pair of electrodes configured to generate resistance heat in the heat generation material; wherein the pair of electrodes include: a first electrode configured to be connected to one pole of a power source; and a second electrode configured to be connected to the other pole of the power source; and wherein the sectional areas of at least some portions of the first electrode and the second electrode are determined such that a plurality of electric circuits formed by the first electrode, the heat generation material, and the second electrode can have the theoretically same resistance.

The first electrode may include first branch electrodes branched off from the first primary electrode; the second electrode may include second branch electrodes branched off from the second primary electrode; and the first primary electrode and the second primary electrode may be disposed opposite to each other, and the sectional areas of the branch electrodes may be made different from each other such that the plurality of electric circuits can have the theoretically same resistance.

The sectional areas of the branch electrodes may be increased in proportion to their distances from power input points at which power is input to the first electrode and the second electrode.

The branch electrodes may be each divided into two twig electrodes; each adjacent two of the twig electrodes having different poles may have the same sectional area; and, of the twig electrodes constituting each of the branch electrodes, the twig electrode farther from the power source input points may have a larger sectional area than the twig electrode closer to the power source input points.

The first or second electrode may further include a blocking electrode branched off from the first or second primary electrode in order to prevent a direct electric circuit from being formed between the first or second primary electrode and one of the branch electrodes that have opposite poles.

The first electrode may include first branch electrodes branched off from the first primary electrode; the second electrode may include second branch electrodes branched off from the second primary electrode; and the first branch electrodes and the second branch electrodes may be provided in arc shapes, and the sectional areas of the branch electrodes may be increased in a direction from the center of a circle to the outside thereof.

The sectional areas of at least some portions of electrodes constituting the electric circuits may be increased in proportion to the distances over which current flows in the corresponding electric circuits.

According to a second aspect of the present invention, there is provided a plane heater including: a nonconductor substrate; a heat generation material applied to the nonconductor substrate; and a pair of electrodes configured to generate resistance heat in the heat generation material; wherein the pair of electrodes include: a first electrode configured to be connected to one pole of a power source; and a second electrode configured to be connected to the other pole of the power source; and wherein the intervals between at least some portions of the first electrode and the second electrode are determined such that a plurality of electric circuits formed by the first electrode, the heat generation material, and the second electrode can have the theoretically same resistance.

The first electrode may include first branch electrodes branched off from the first primary electrode; the second electrode may include second branch electrodes branched off from the second primary electrode; and the first primary electrode and the second primary electrode may be disposed opposite to each other, and the intervals between the branch electrodes may be made different from each other such that the plurality of electric circuits can have the theoretically same resistance.

The intervals between the branch electrodes may be decreased in proportion to their distances from power input points at which power is input to the first electrode and the second electrode.

The first or second electrode may further include a blocking electrode branched off from the first or second primary electrode in order to prevent a direct electric circuit from being formed between the first or second primary electrode and one of the branch electrodes that have opposite poles.

The first electrode may include first branch electrodes branched off from the first primary electrode; the second electrode may include second branch electrodes branched off from the second primary electrode; and the first branch electrodes and the second branch electrodes may be provided in arc shapes, and the intervals between the branch electrodes may be decreased in a direction from the outside of a circle to the center thereof.

The intervals between at least some portions of electrodes constituting the electric circuits may be decreased in proportion to distances over which current flows in the corresponding electric circuits.

The sectional areas of at least some portions of the first electrode and the second electrode may be determined such that the plurality of electric circuits formed by the first electrode, the heat generation material, and the second electrode can have the theoretically same resistance.

According to a third aspect of the present invention, there is provided a plane heater including: a nonconductor substrate; a heat generation material applied to the nonconductor substrate; a pair of electrodes configured to generate resistance heat in the heat generation material; and a bridge configured to serve as a medium for a current flow between the pair of electrodes; wherein the pair of electrodes include: a first electrode configured to be connected to one pole of a power source; and a second electrode configured to be connected to the other pole of the power source; and wherein the bridge is disposed to serve as a medium for a current flow between the first electrode and the second electrode.

The bridge may include a plurality of bridges, and the plurality of bridges may be disposed such that current can flow between the first electrode and the second electrode through at least two of the bridges.

Linear cut regions formed by cutting a heat generation material layer may be provided such that current can flow between the first electrode and the second electrode through the at least two of the bridges.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

Embodiments of the present invention will be described in detail with reference to the accompanying drawings, but descriptions of redundant technical items will be omitted or abridged for brevity of description.

For reference, in the following description of the present invention, it is assumed that heat generation material, such as graphene or the like, is uniformly applied to a nonconductor substrate. Based on this assumption, the following description will be given on a focus on the structures of arrangements of first and second electrodes, which are the characteristic parts of the present invention.

<Embodiments According to a First Aspect of the Present Invention>

1. First Embodiment

Figure 1:
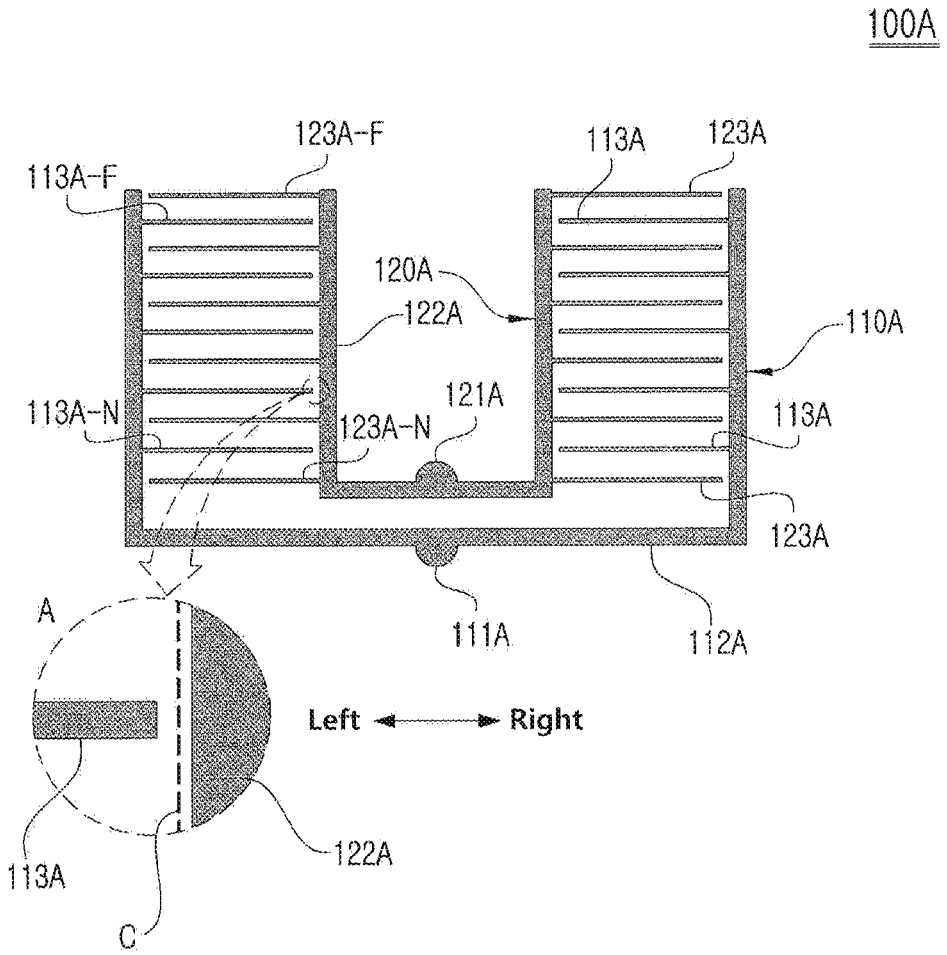
FIG. 1 shows a first embodiment of the electrodes of a plane heater according to a first aspect of the present invention.

FIG. 1 is a view illustrating an arrangement of electrodes in a plane heater 100A that is implemented as a first embodiment according to a first aspect of the present invention.

The plane heater 100A according to the present embodiment includes a pair of first and second electrodes 110A and 120A configured to generate resistance heat in heat generation material.

The first electrode 110A includes a first power input point 111A, a first primary electrode 112A, and a plurality of first branch electrodes 113A.

The first power input point 111A is connected to the + pole or − pole of a power source.

The first primary electrode 112A is extended in a U shape in left and right directions from the first power input point 111A.

The plurality of first branch electrodes 113A is branched off from the first primary electrode 112A, and is extended in an inward direction, i.e., a direction toward the second electrode 120A to be described below.

In the same manner, the second electrode 120A includes a second power input point 121A, a second primary electrode 122A, and a plurality of second branch electrodes 123A.

The second power input point 121A is connected to the pole of the power source that is opposite to the pole to which the first power input point 111A is connected.

The second primary electrode 122A is spaced apart from the first primary electrode 112A while facing the first primary electrode 112A, and is extended in a U shape in left and right directions from the second power input point 121A.

The plurality of second branch electrodes 123A is branched off from the second primary electrode 122A, and is extended in an outward direction, i.e., a direction toward the first primary electrode 112A.

In the present embodiment, the first branch electrodes 113A and the second branch electrodes 123A are alternately arranged, and thus current can flow across the heat generation material between the first branch electrodes 113A and the second branch electrodes 123A. In other words, the first branch electrodes 113A and the second branch electrodes 123A are arranged in such a manner that each of the second branch electrodes 123A is located between corresponding adjacent two of the first branch electrodes 113A.

In the present embodiment, when the first power input point 111A is connected to the + pole of the power source, current flows along a plurality of electric circuits that are connected in the sequence of the first power input point 111A, the first primary electrode 112A, the plurality of first branch electrodes 113A, the heat generation material, the plurality of second branch electrodes 123A, the second primary electrode 122A, and the second power input point 121A. In this case, as current flows across the heat generation material, resistance heat is generated due to the resistance of the heat generation material.

According to the present invention, it is required that all the theoretically possible electric circuits connected from the first power input point 111A to the second power input point 121A have the same resistance. In that case, the amount of current flowing through the heat generation material between both branch electrodes 113A and 123A becomes the same in all areas, with the result that the same resistance heat can be generated in all areas where the heating material is present.

Figure 2:
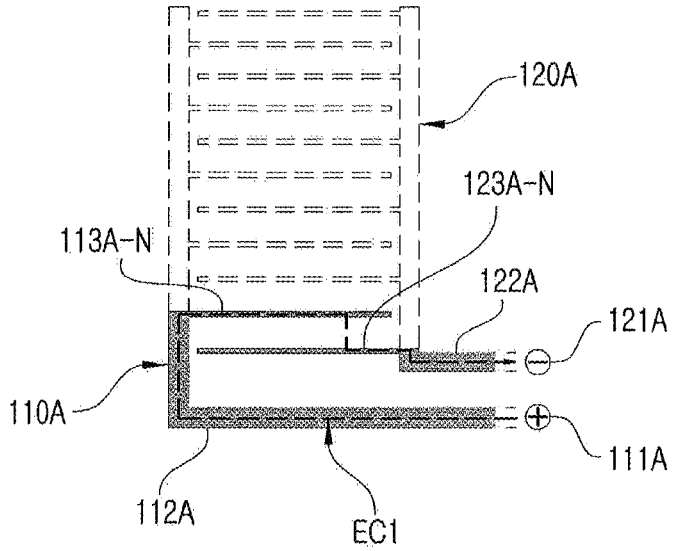
FIG. 2 shows excerpts of two representative electric circuits that are taken from the electrodes of FIG. 1.
Figure 2:
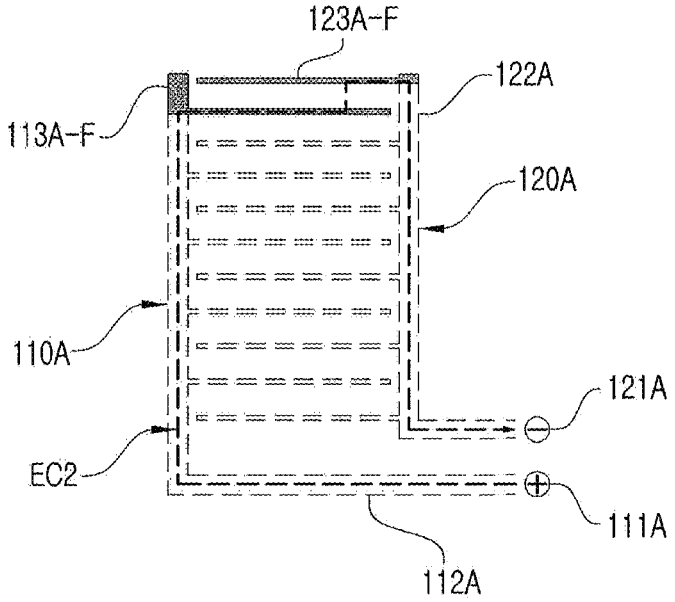

FIGS. 2(*a*) and 2(*b*) are excerpts of two electric circuits that are taken from FIG. 1 as an example.

Referring to FIG. 2, there are shown a first electric circuit EC1 (see FIG. 2(*a*)) in which a first branch electrode 113A-N and a second branch electrode 123A-N closest to both the power input points 111A and 121A are included, and a second electric circuit EC2 (see FIG. 2(*b*)) in which a first branch electrode 113A-F and a second branch electrode 123A-F farthest from both the power input points 111A and 121A are included.

From FIG. 2, it can be seen that the first electric circuit EC1 is significantly shorter than the second electric circuit EC2.

Generally, resistance is known to be present not only in the heat generation material but also in both the primary electrodes 112A and 122A and the branch electrodes 113A and 123A. In other words, it can be seen that the first electric circuit EC1 has lower resistance than the second electric circuit EC2 when viewed only from the point of view of the lengths of the electric circuits EC1 and EC2. Accordingly, it can be seen that a larger amount of current flows along the first electric circuit EC1 and thus a larger amount of resistance heat is generated in the heat generation material between both the branch electrodes 113A-N and 123A-N that are present in the corresponding circuit.

Figure 3:
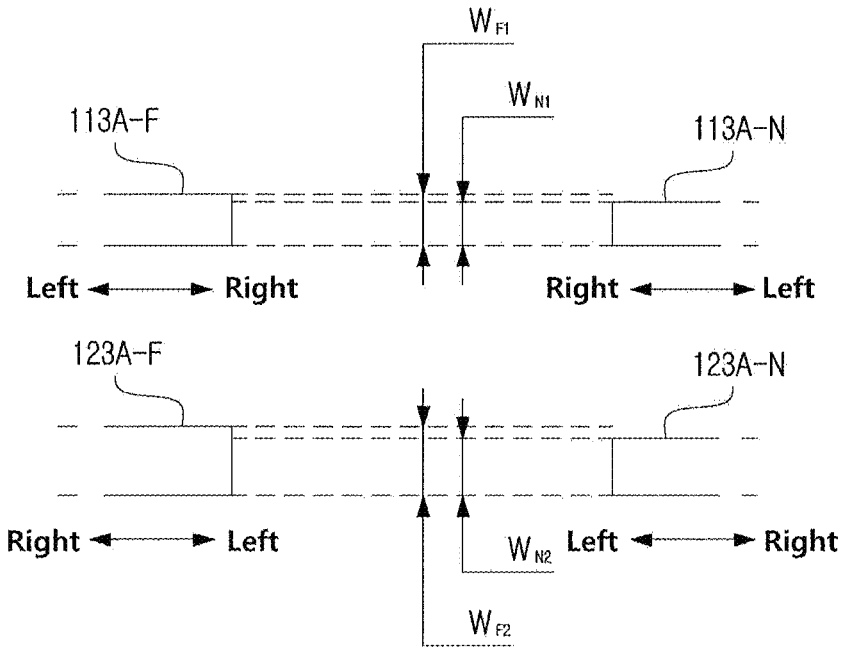
FIG. 3 is a reference diagram illustrating a difference in width between the branch electrodes of FIG. 1.

By the way, in the present invention, as compared and shown in FIG. 3 in an exaggerated manner, the widths $W_{F1}$ and $W_{F2}$ of both the branch electrodes 113A-F and 123A-F constituting the second electric circuit EC2 are made larger than the widths $W_{N1}$ and $W_{N2}$ of both the branch electrodes 113A-N and 123A-N constituting the first electric circuit EC1, and thus the resistance of both the branch electrodes 113A-F and 123A-F constituting the second electric circuit EC2 is made lower than the resistance of both the branch electrodes 113A-N and 123A-N constituting the first electric circuit EC1. The difference between the widths of the branch electrodes 112A and 113A is determined to be a value at which all the electric circuits have the same the resistances. In this case, it is assumed that the coating thickness of both the branch electrodes 113A-F and 123A-F constituting the second electric circuit EC2 is ideally the same as the coating thickness of both the branch electrodes 113A-N and 123A-N constituting the first electric circuit EC1.

In other words, the resistance in both the branch electrodes 113A-F and 123A-F constituting the second electric circuit EC2 and the resistance in both the branch electrodes 113A-N and 123A-N constituting the first electric circuit EC1 are made different from each other. In this case, the difference in the resistance is set such that the overall resistance of the first electric circuit EC1 and the overall resistance of the second electric circuit EC2 have the ideally same value.

It will be apparent that the difference in the sectional area may be set by changing the thicknesses of both the branch electrodes 113A and 123A or the widths and thicknesses thereof because resistance is inversely proportional to the sectional area of a conductive line. However, when the branch electrodes 113A and 123A are printed, changing the widths is more advantageous in terms of a process than changing the thicknesses, and thus it may be preferably taken into account that the widths of the branch electrodes 113A and 123A are made different from each other, as in the present embodiment.

In other words, according to the present embodiment, all the electric circuits that can be theoretically taken into account are made to have the same resistance in such a manner that the widths of the branch electrodes 113A and 123A are decreased as the branch electrodes 113A and 123A become closer to the power input points 111A and 121A and the widths of the branch electrodes 113A and 123A are increased as the branch electrodes 113A and 123A become farther from the power input points 111A and 121A.

For reference, referring to enlarged portion A of FIG. 1, in order to prevent a direct current flow from occurring in a direction from the first branch electrode 113A to the second primary electrode 122A, it may be taken into account that a cut line C or uncoated region configured to block a current flow is placed on the heat generation material of a corresponding portion. It will be apparent that such a cut line C or uncoated region may be placed on any portion where an unintended current flow occurs between the branch electrode 113A or 123A and the primary electrode 112A or 122A. This is also applied to other embodiments.

2. Second Embodiment

Figure 4:
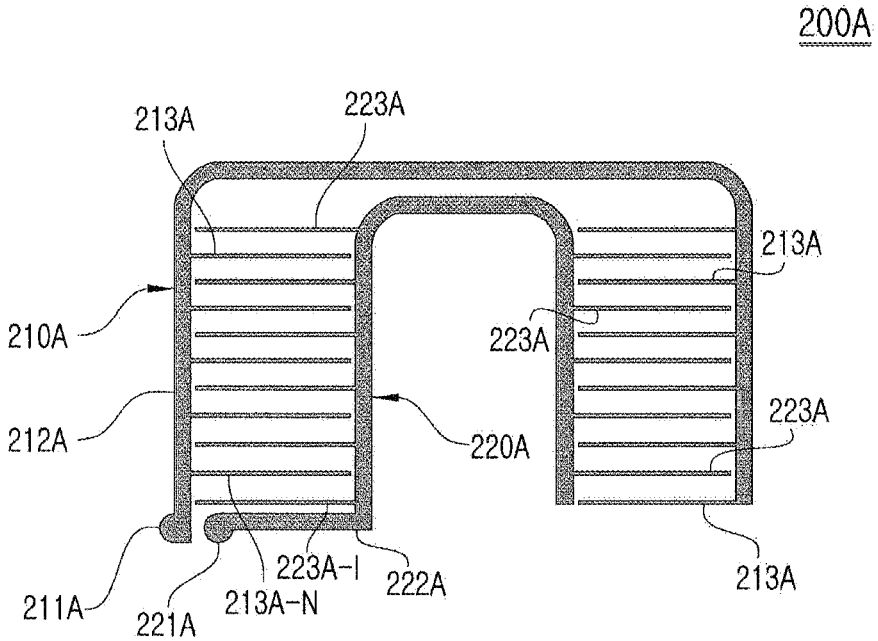
FIG. 4 shows a second embodiment of the electrodes of a plane heater according to the first aspect of the present invention.

FIG. 4 is a view illustrating an arrangement of electrodes in a plane heater 200A that is implemented as a second embodiment according to the first aspect of the present invention.

In the present embodiment, both power input points 211A and 221A are off-centered to one side on a first electrode 210A and a second electrode 220A unlike those of the first embodiment. In the present embodiment, all the electric circuits that can be ultimately taken into account are made to have the same resistance in such a manner that the widths of branch electrodes 213A and 223A are increased as the branch electrodes 213A and 223A become farther from the power input points 211A and 223A.

In the present embodiment, a blocking electrode 223A-I branched off from a second primary electrode 222A is disposed such that the second primary electrode 222A having a portion parallel to the branch electrodes 213A and 223A can be prevented from being directly adjacent to a branch electrode 213A branched off from a first primary electrode 212A. Accordingly, an electric circuit can be prevented from being formed between a first branch electrode 213A-N closest to the first power input point 211A and the portion of the second primary electrode 222A parallel to the first branch electrode 213A-N. It will be apparent that the first primary electrode may be configured to have a portion parallel to the branch electrodes depending on implementation, in which case a blocking electrode may be branched off from the first primary electrode.

3. Third Embodiment

Figure 5:
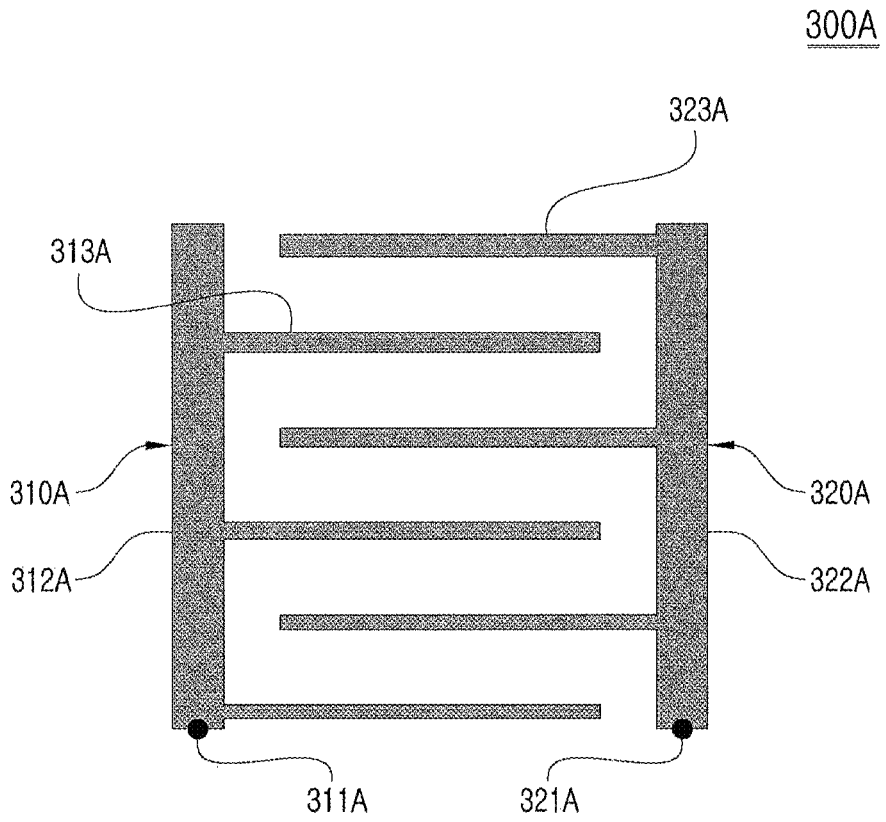
FIG. 5 shows a third embodiment of the electrodes of a plane heater according to the first aspect of the present invention.

FIG. 5 is a view illustrating an arrangement of electrodes in a plane heater 300A that is implemented as a third embodiment according to the first aspect of the present invention.

According to the example of FIG. 5, in a first electrode 310A and a second electrode 320A, primary electrodes 312A and 322A are extended from separate power input points 311A and 321A, respectively, in parallel to each other. Furthermore, branch electrodes 313A and 323A are branched off from the primary electrodes 312A and 322A, and are alternately arranged. In this case, the widths of the branch electrodes 313A and 323A are increased as the branch electrodes 313A and 323A become farther from the power input points 311A and 321A, in the same manner as in the previous embodiments.

4. Fourth Embodiment

Figure 6:
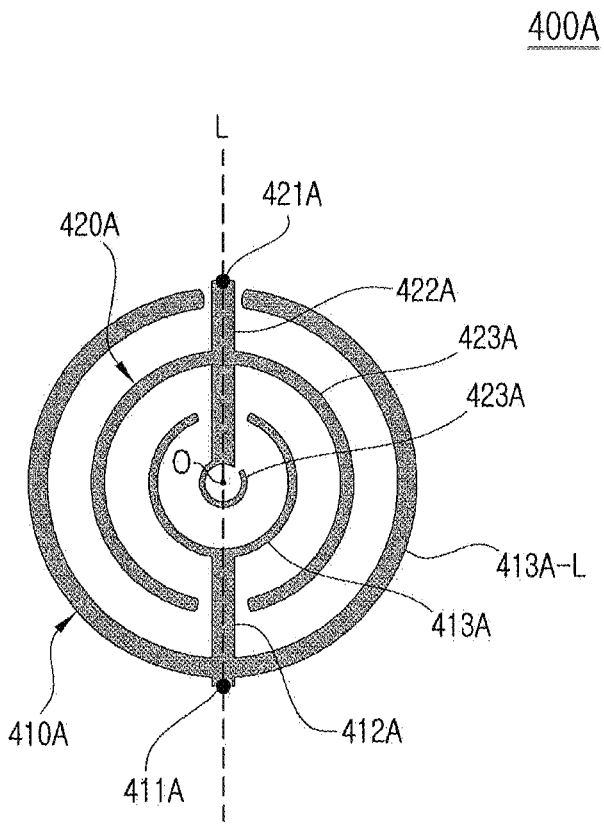
FIG. 6 shows a fourth embodiment of the electrodes of a plane heater according to the first aspect of the present invention.

FIG. 6 is a view illustrating an arrangement of electrodes in a plane heater 400A that is implemented as a fourth embodiment according to the first aspect of the present invention.

The plane heater 400A according to the present embodiment also includes: a first electrode 410A including a first power input point 411A, a first primary electrode 412A, and first branch electrodes 413A; and a second electrode 420A including a second power input point 421A, a second primary electrode 422A, and second branch electrodes 423A.

In the present embodiment, the branch electrodes 413A and 423A are arranged in arc shapes. Furthermore, the first power input point 411A and the second power input point 421A are disposed on both corresponding sides, respectively, on a line L that passes through the center O of the outermost branch electrode 413A-L having the largest radius. In other words, the first power input point 411A and the second power input point 421A are disposed as far as possible from each other.

Furthermore, the branch electrodes 413A and 423A are provided in the form of arcs having different radii, and are disposed such that opposite poles can be adjacent to each other.

In the present embodiment, the widths of the branch electrodes 413A and 423A are increased in a direction from the center a circle to the outside thereof so that the widths (and/or thicknesses) of the branch electrodes 413A and 423A are increased in proportion to the distance over which current flows.

5. Fifth Embodiment

Figure 7:
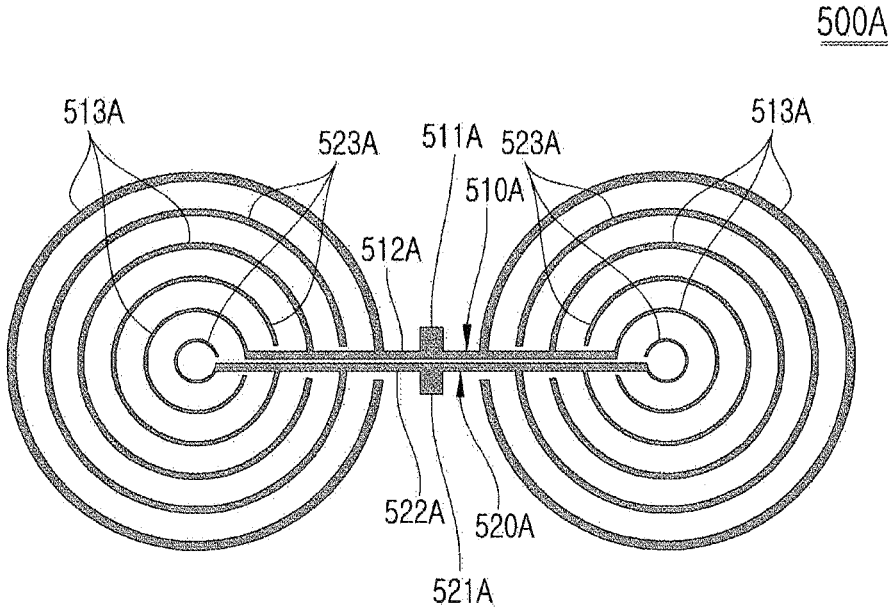
FIG. 7 shows a fifth embodiment of the electrodes of a plane heater according to the first aspect of the present invention.

A plane heater 500A shown in FIG. 7 is configured such that both power input points 511A and 521A of both electrodes 510A and 520A are gathered together and arranged on the same side and branch electrodes 513A and 523A branched off from primary electrodes 512A and 522A are divided into both sides and formed in arc shapes, unlike that shown in FIG. 6. In this case, it will be apparent that the widths (and/or thicknesses) of the branch electrodes 513A and 523A are increased in a direction from the center of a circle to the outside thereof.

5. Sixth Embodiment

Figure 8:
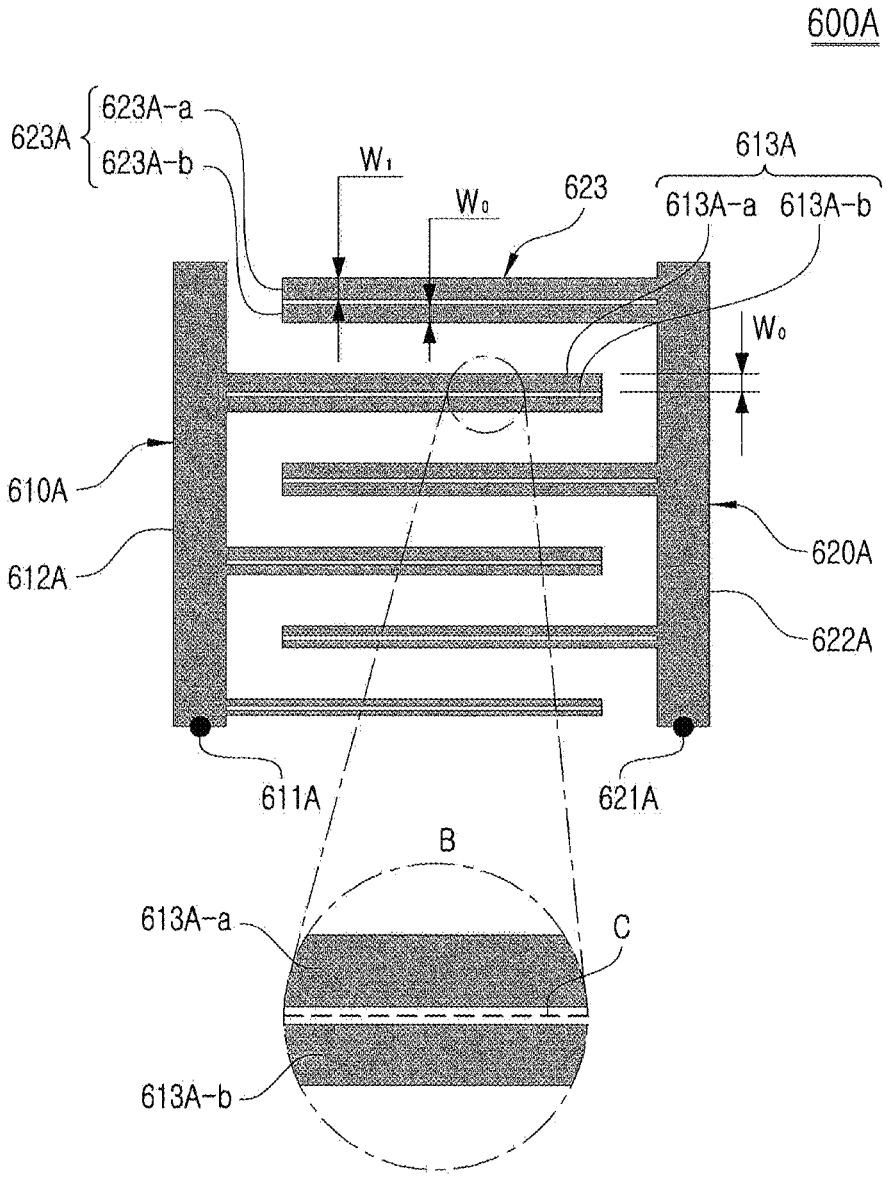
FIG. 8 shows a sixth embodiment of the electrodes of a plane heater according to the first aspect of the present invention.

FIG. 8 is a view illustrating an arrangement of electrodes in a plane heater 600A that is implemented as a sixth embodiment according to the first aspect of the present invention.

The plane heater 600A according to the sixth embodiment includes a pair of first and second electrodes 610A and 620A configured to generate resistance heat in heat generation material.

The first electrode 610A includes a first power input point 611A, a first primary electrode 612A, a plurality of first branch electrodes 613A, and the second electrode 620A includes a second power input point 621A, a second primary electrode 622A, and a plurality of second branch electrodes 623A, in the same manner as in the above-described first to third embodiments.

The present embodiment is characterized in that each of the first branch electrodes 613A includes two twig electrodes 613A-a and 613A-b and the second branch electrode 623A includes two twig electrodes 623A-a and 623A-b.

In the present embodiment, the sectional areas of the branch electrodes 613A and 623A are increased as the branch electrodes 613A and 623A become farther from the power input points 611A and 621A in the same manner as in the previous embodiments. However, each of the branch electrodes 613A and 623A is divided into the twig electrodes 613A-a and 613A-b, or 623A-a and 623A-b, in which case it will be apparent that the twig electrodes 613A-a and 613A-b, or 623A-a and 623A-b constituting each of the branch electrodes 613A and 623A have the same pole.

In the present embodiment, the adjacent twig electrodes (e.g., 613A-a and 623A-b) having different poles have the same width $W_0$ (more specifically, the same sectional area) and a uniform current flow is formed therebetween, and the twig electrodes 623A-a and 623A-b constituting each branch electrode (e.g., 623A) are configured such that the width $W_1$ (more specifically, the sectional area) of the twig electrode 623A-a farther from the power source input point 621A is larger than the width $W_0$ (more specifically, the sectional area) of the twig electrode 623A-b closer to the power source input point 621A ($W_0<W_1$). Via this structure, uniform current flows can be distributed over the overall area of the heat generation materials between the branch electrodes 613A and 623A. It will be apparent that this structure includes all the branch electrodes 613A and 613A shown in FIG. 8.

Meanwhile, referring to enlarged portion B of FIG. 8, it is preferable to place a cut line C or uncoated region between the twig electrodes 613A-a and 613A-b, or 623A-a and 623A-b.

<Embodiments According to a Second Aspect of the Present Invention>

Since the patterns of the electrodes of embodiments according to a second aspect of the present invention are similar to those of the embodiments according to the first aspect, the embodiments will be described in brief as much as possible.

1. First Embodiment

Figure 9:
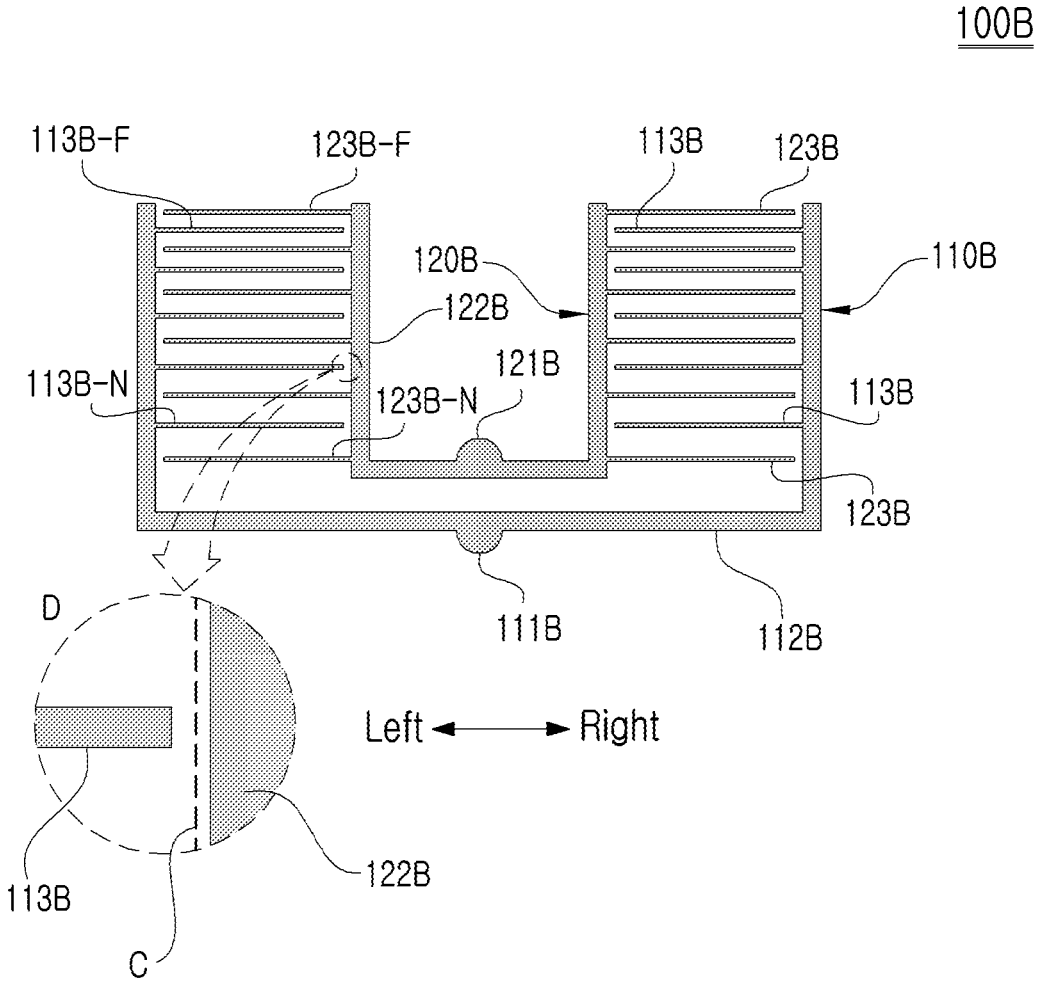
FIG. 9 shows a first embodiment of the electrodes of a plane heater according to a second aspect of the present invention.

FIG. 9 is a view illustrating an arrangement of electrodes in a plane heater 100B that is implemented as a first embodiment according to the second aspect of the present invention.

The plane heater 100B according to the first embodiment includes a pair of first and second electrodes 110B and 120B configured to generate resistance heat in heat generation material.

The first electrode 110B includes a first power input point 111B, a first primary electrode 112B, and a plurality of first branch electrodes 113B.

The first power input point 111B is connected to the + pole and − pole of a power source.

The first primary electrode 112B is extended in a U shape in left and right directions from the first power input point 111B.

The plurality of first branch electrodes 113B is branched off from the first primary electrode 112B, and is extended in an inward direction, i.e., a direction toward the second electrode 120B to be described below.

In the same manner, the second electrode 120B includes a second power input point 121B, a second primary electrode 122B, and a plurality of second branch electrodes 123B.

The second power input point 121B is connected to the pole of the power source that is opposite to the pole to which the first power input point 111B is connected.

The second primary electrode 122B is spaced apart from the first primary electrode 112B while facing the first primary electrode 112B, and is extended in a U shape in left and right directions from the second power input point 121B.

The plurality of second branch electrodes 123B is branched off from the second primary electrode 122B, and is extended from an outward direction, i.e., a direction toward the first primary electrode 112B.

In the present embodiment, the first branch electrode 113B and the second branch electrodes 123B are alternately arranged, and thus current can flow across the heat generation material between the first branch electrodes 113B and the second branch electrodes 123B.

In the present embodiment, when the first power input point 111B is connected to the + pole of the power source, current flows along a plurality of electric circuits that are connected in the sequence of the first power input point 111B, the first primary electrode 112B, the plurality of first branch electrodes 113B, the heat generation material, the plurality of second branch electrodes 123B, the second primary electrode 122B, and the second power input point 121B.

According to the present invention, it is required that all the theoretically possible electric circuits connected from the first power input point 111B to the second power input point 121B have the same resistance.

Figure 10:
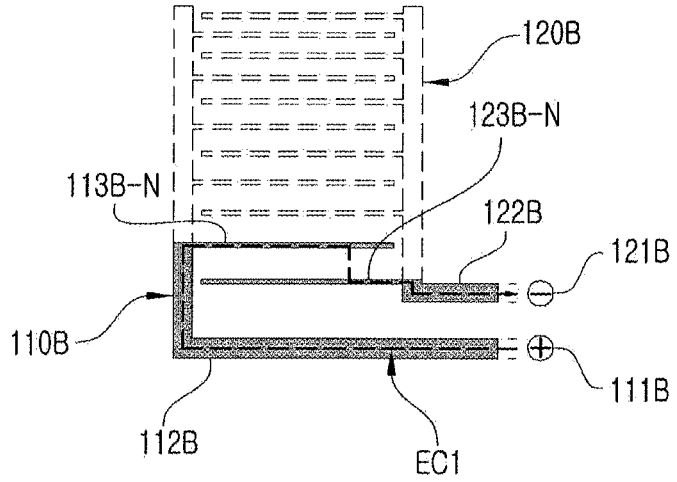
FIG. 10 shows excerpts of two representative electric circuits that are taken from the electrodes of FIG. 9.
Figure 10:
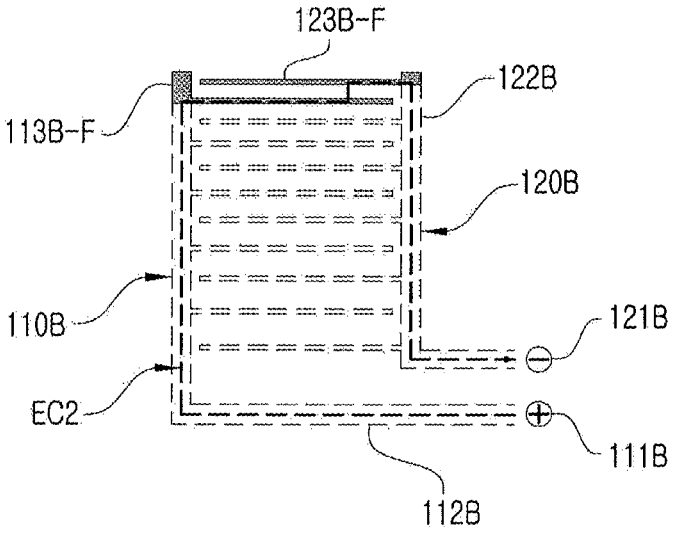

FIGS. 10(*a*) and 10(*b*) are excerpts of two electric circuits that are taken from FIG. 9 as an example.

Referring to FIG. 10, there are shown a first electric circuit EC1 in which a first branch electrode 113B-N and a second branch electrode 123B-N closest to both the power input points 111B and 121B are included, and a second electric circuit EC2 in which a first branch electrode 113B-F and a second branch electrode 123B-F farthest from both the power input points 111B and 121B. The first electric circuit EC1 is significantly shorter than the second electric circuit EC2 in the same manner as in the first aspect of the present invention.

Figure 11:
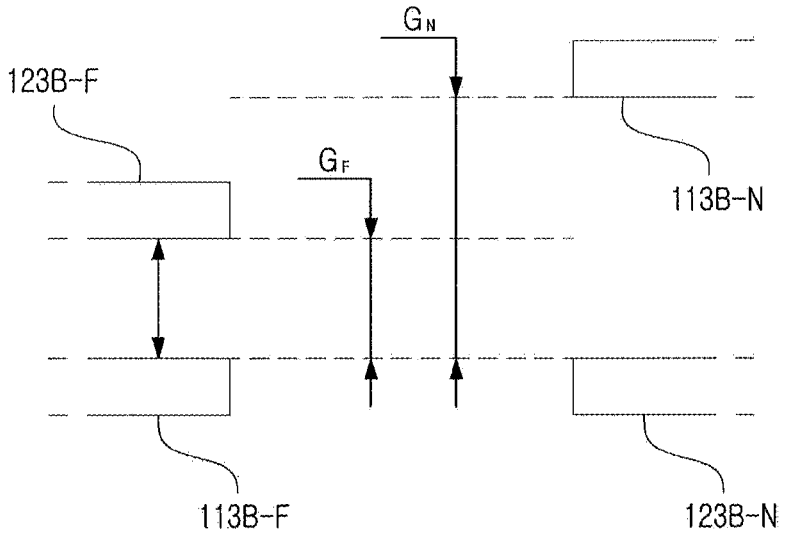
FIG. 11 is a reference diagram illustrating a difference in interval between the branch electrodes of FIG. 9.

By the way, in the second aspect of the present invention, as compared and shown in FIG. 11 in an exaggerated manner, the interval $G_F$ between both the branch electrodes 113B-F and 123B-F constituting the second electric circuit EC2 is made larger than the interval $G_N$ between both the branch electrodes 113B-N and 123B-N constituting the first electric circuit EC1, and thus the resistance of the heat generation material between both the branch electrodes 113B-F and 123B-F constituting the second electric circuit EC2 is made lower than the resistance of the heat generation material between both the branch electrodes 113B-N and 123B-N constituting the first electric circuit EC1. The difference in the interval between the branch electrodes 112B and 113B may be determined to be a value at which all the electric circuits can have the same resistance.

In other words, the resistance of the heat generation material between both the branch electrodes 113B-F and 123B-F constituting the second electric circuit EC2 and the resistance of the heat generation material between both the branch electrodes 113B-N and 123B-N constituting the first electric circuit EC1 is made different from each other. In this case, the difference in the resistance is set such that the resistance of the first electric circuit EC1 and the resistance of the second electric circuit EC2 have the ideally same value.

Accordingly, according to the present embodiment, all the electric circuits that can be theoretically taken into account are made to have the same resistance in such a manner that the widths of the branch electrodes 113B and 123B are decreased as the branch electrodes 113B and 123B become closer to the power input points 111B and 121B and the widths of the branch electrodes 113B and 123B are increased as the branch electrodes 113B and 123B become farther from the power input points 111B and 121B.

Meanwhile, resistance is inversely proportional to the sectional area of a conductive line. As in the technology described as the first aspect of the present invention, it may be taken into account that the resistance values of all the electric circuits are made the same by appropriately applying a method of changing the widths or thicknesses of the branch electrodes 113B and 123B and a method of changing the intervals between the branch electrodes 113B and 123B. A method of changing the intervals between electrodes or branch electrodes and the sectional areas of electrodes or branch electrodes in order to make resistances to be the same may be efficiently applied to a plane heater having a wide heat generation area.

In the same manner, referring to enlarged portion D of FIG. 9, in order to prevent a direct current flow from occurring in a direction from the first branch electrode 113B to the second primary electrode 122B, it may be taken into account that a cut line C or uncoated region configured to block a current flow is placed on the heat generation material of a corresponding portion. It will be apparent that such a cut line C or uncoated region may be placed on any necessary portion in other embodiments.

2. Second Embodiment

Figure 12:
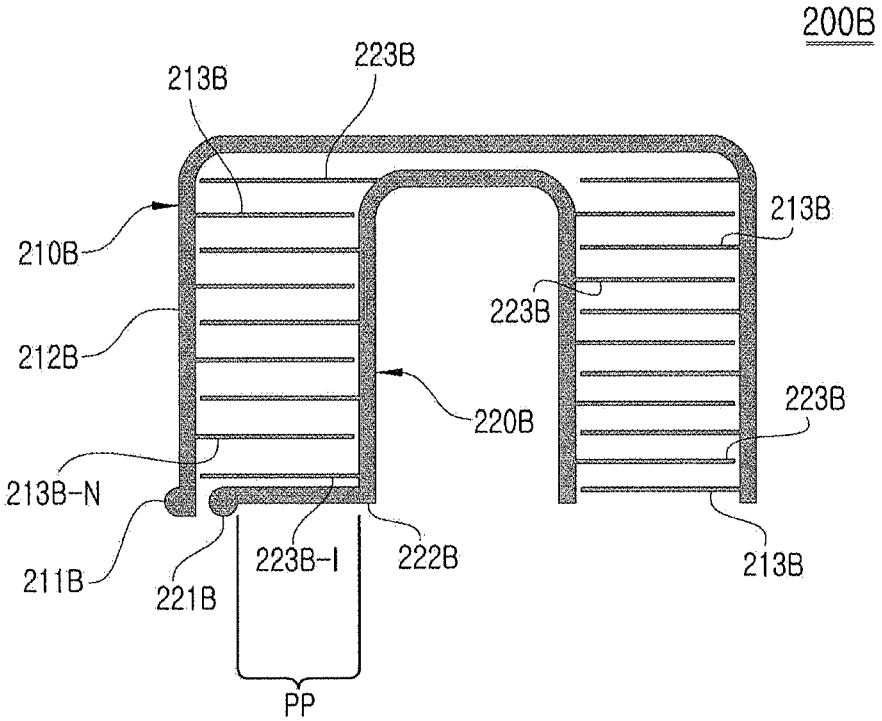
FIG. 12 shows a second embodiment of the electrodes of a plane heater according to the second aspect of the present invention.

FIG. 12 is a view illustrating an arrangement of electrodes in a plane heater 200B that is implemented as a second embodiment according to the second aspect of the present invention.

In the present embodiment, both power input points 211B and 221B are off-centered to one side on a first electrode 210B and a second electrode 220B unlike those of the first embodiment. In the present embodiment, all the electric circuits that can be taken into account are made to have the same resistance in such a manner that the intervals between branch electrodes 213B and 223B are decreased as the branch electrodes 213B and 223B become farther from the power input points 211B and 223B.

In the present embodiment, a blocking electrode 223B-I branched off from a second primary electrode 222B is disposed such that the second primary electrode 222B having a portion parallel to the branch electrodes 213B and 223B can be prevented from being directly adjacent to a branch electrode 213B branched off from a first primary electrode 212B. Accordingly, an electric circuit can be prevented from being formed between a first branch electrode 213B-N closest to the first power input point 211B and the portion of the second primary electrode 222B parallel to the first branch electrode 213B-N. It will be apparent that the first primary electrode may be configured to have a portion parallel to the branch electrodes depending on implementation, in which case a blocking electrode may be branched off from the first primary electrode.

3. Third Embodiment

Figure 13:
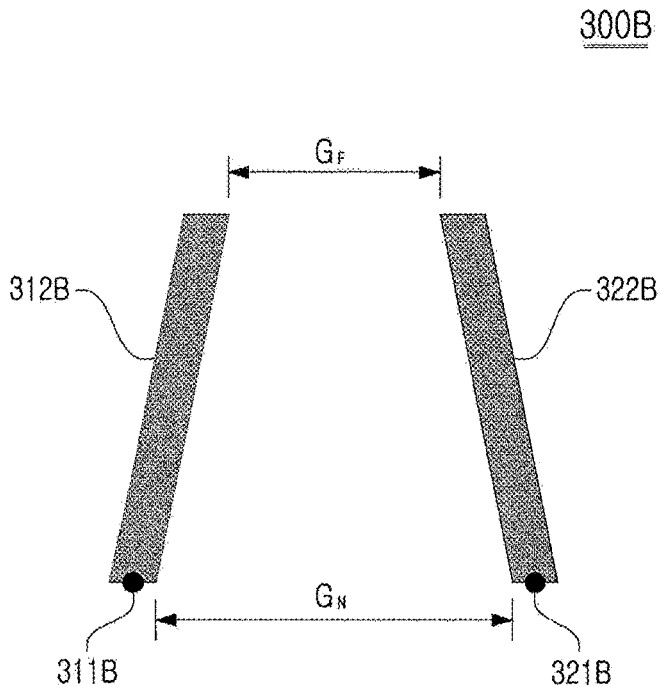
FIG. 13 shows a third embodiment of the electrodes of a plane heater according to the second aspect of the present invention.

FIG. 13 is a view illustrating an arrangement of electrodes in a plane heater 300B that is implemented as a third embodiment according to the second aspect of the present invention.

FIG. 13 is illustrated in an exaggerated manner. In a first electrode 310B and a second electrode 320B, primary electrodes 312B and 322B are extended from power input points 311B and 321B, respectively, in rectilinear line shapes without separate branch electrodes. In this case, the interval between corresponding portions of the primary electrodes 312B and 322B is increased as the corresponding portions of the primary electrodes 312B and 322B become farther from the power input points 311B and 321B (GF<GN).

Figure 14:
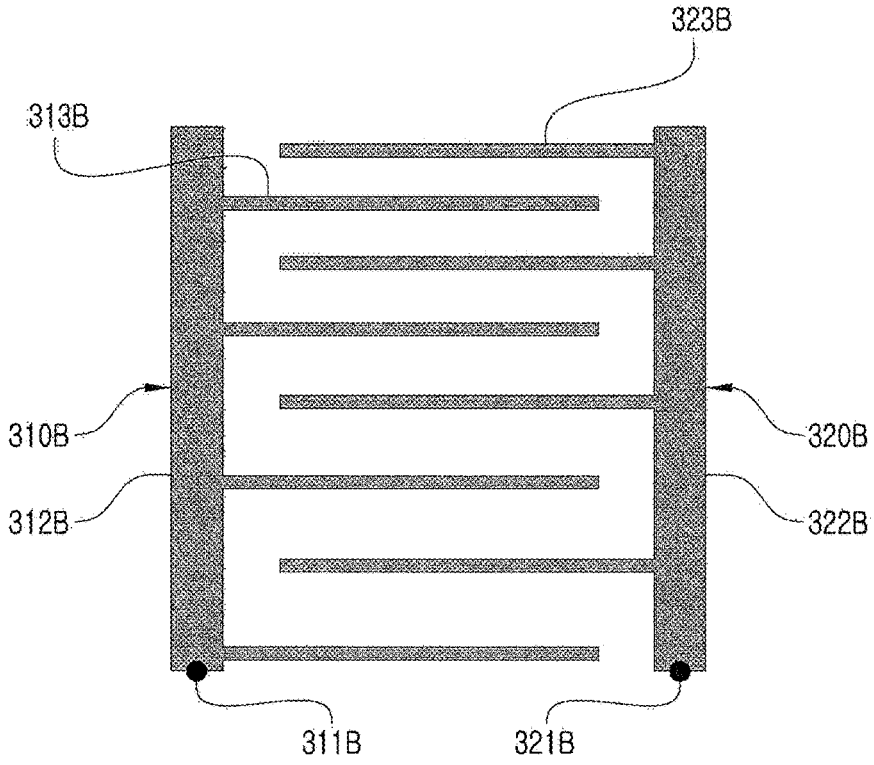
FIG. 14 illustrates the electrodes of a plane heater according to a modification of the embodiment of FIG. 13.

The present embodiment may be modified to that shown in FIG. 14. This may be implemented such that a first primary electrode 312B and a second primary electrode 322B are disposed in parallel to each other and a plurality of first branch electrodes 313B and a plurality of second branch electrodes 323B are branched off from the first primary electrode 312B and the second primary electrode 322B, respectively. This modification needs to be configured such that the intervals between the first branch electrodes 313B and the second branch electrodes 323B are decreased in proportion to their distances from the power input points 311B and 321B.

4. Fourth Embodiment

Figure 15:
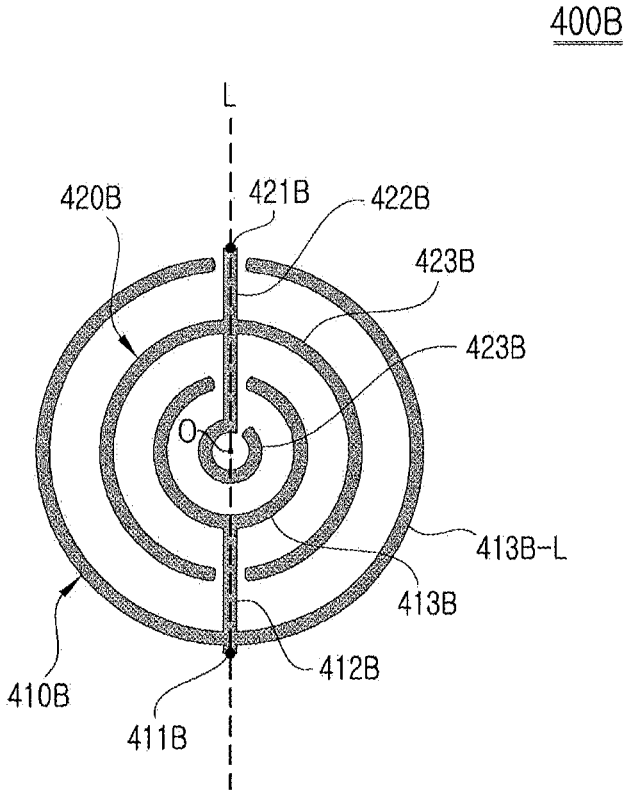
FIG. 15 shows a fourth embodiment of the electrodes of a plane heater according to the second aspect of the present invention.

FIG. 15 is a view illustrating an arrangement of electrodes in a plane heater 400B that is implemented as a fourth embodiment according to the second aspect of the present invention.

The plane heater 400B according to the present embodiment also includes: a first electrode 410B including a first power input point 411B, a first primary electrode 412B, and first branch electrodes 413B; and a second electrode 420B including a second power input point 421B, a second primary electrode 422B, and second branch electrodes 423B.

In the present embodiment, the branch electrodes 413B and 423B are arranged in arc shapes. Furthermore, the first power input point 411B and the second power input point 421B are disposed on both corresponding sides, respectively, on a line L that passes through the center O of the outermost branch electrode 413B-L having the largest radius.

Furthermore, the branch electrodes 413B and 423B are provided in the form of arcs having different radii, and are disposed such that opposite poles can be adjacent to each other.

In the present embodiment, the intervals between the branch electrodes 413B and 423B are decreased in a direction from the outside of a circle to the center O thereof so that the intervals between the branch electrodes 413B and 423B are decreased in inverse proportion to their distances from both the power input points 411B and 421B.

5. Fifth Embodiment

Figure 16:
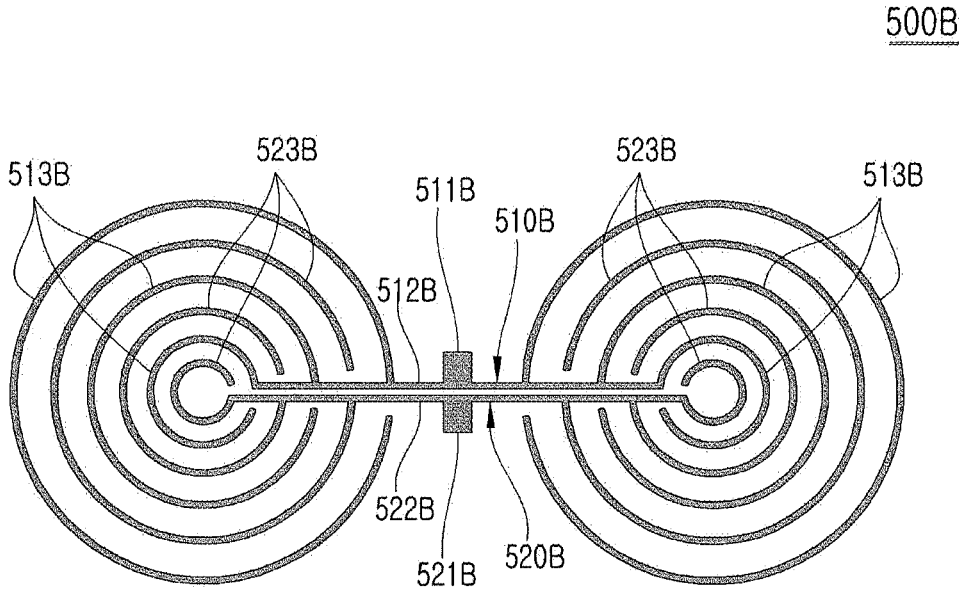
FIG. 16 shows a fifth embodiment of the electrodes of a plane heater according to the second aspect of the present invention.

A plane heater 500B shown in FIG. 16 is configured such that both power input points 511B and 521B of both electrodes 510B and 520B are gathered together and arranged on the same side and branch electrodes 513B and 523B branched off from primary electrodes 512B and 522B are divided into both sides and formed in arc shapes, unlike the structure shown in FIG. 15. In this case, it will be apparent that the intervals between the branch electrodes 513B and 523B are decreased in a direction from the outside of a circle to the center thereof.

<Embodiments According to a Third Aspect of the Present Invention>

Embodiments according to a third aspect of the present invention each have a pattern in which a bridge configured to serve as a medium for a current flow between a first electrode and a second electrode in an electric circuit formed between the first electrode and the second electrode is further disposed in addition to the first electrode and the second electrode.

Figure 17:
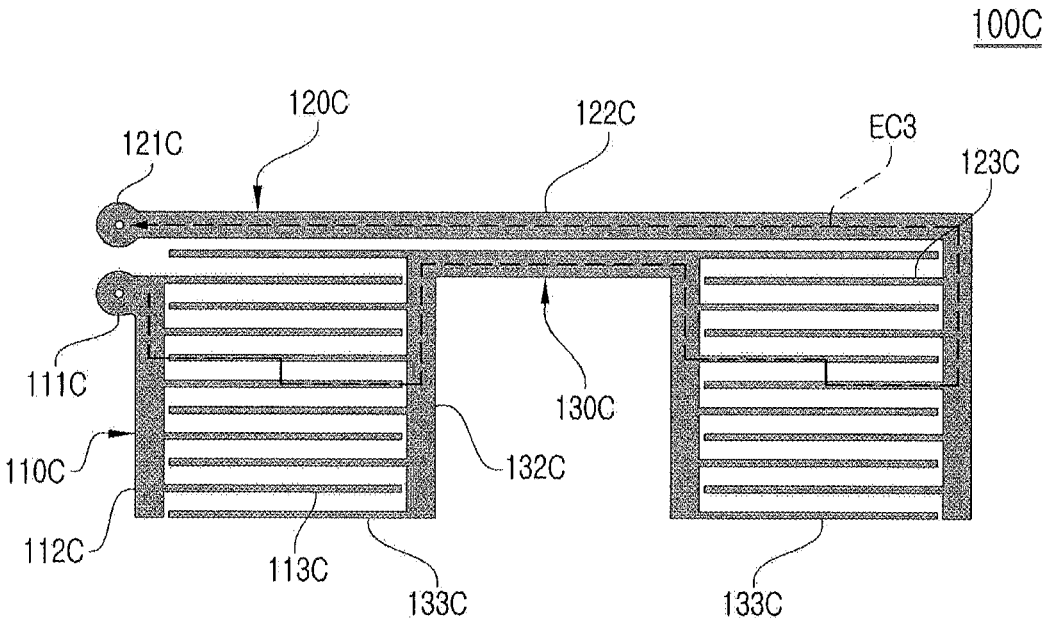
FIG. 17 shows a first embodiment of the electrodes of a plane heater according to a third aspect of the present invention.

FIG. 17 is a view illustrating an arrangement of electrodes in a plane heater 100C that is implemented as a first embodiment of the third aspect of the present invention.

The plane heater 100C according to the first embodiment includes a first electrode 110C, a second electrode 120C, and a bridge 130C in order to generate resistance heat in heat generation material.

The first electrode 110C includes a first power input point 111C, a first primary electrode 112C, and a plurality of first branch electrodes 113C, and the second electrode 120C includes a second power input point 121C, a second primary electrode 122C, and a plurality of second branch electrodes 123C.

The bridge 130C is interposed between the first electrode 110C and the second electrode 120C on an electric circuit including the first electrode 110C and the second electrode 120C, and serves as a medium for a current flow between the first electrode 110C and the second electrode 120C. The bridge 130C does not have a separate power input point, and includes a third primary electrode 132C and a plurality of third branch electrodes 133C.

For example, the present embodiment has a current flow connected in the sequence of a first branch electrode 113C, heat generation material, a third branch electrode 133C, heat generation material, and a second branch electrode 123C, as in one electric circuit EC3 shown in FIG. 17, in place of a current flow connected from a first branch electrode 113C of the first electrode 110C through heat generation material to a second branch electrode 123C of the second electrode 120C.

Figure 18:
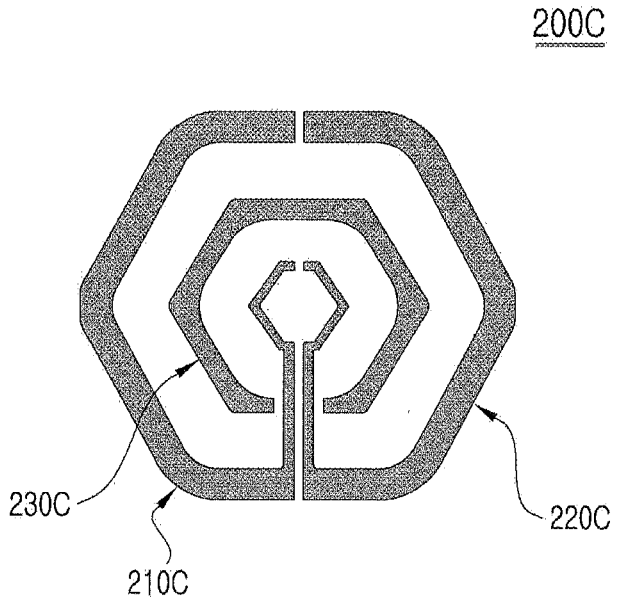
FIG. 18 shows a second embodiment of the electrodes of a plane heater according to the third aspect of the present invention.
Figure 19:
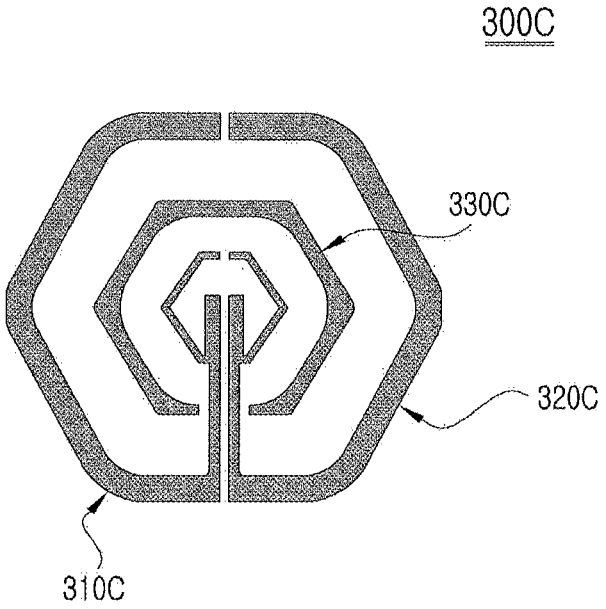
FIG. 19 shows a third embodiment of the electrodes of a plane heater according to the third aspect of the present invention.

Plane heaters 200C and 300C shown in FIG. 18 or 19 are each designed such that a first electrode 210C or 310C and a second electrode 220C or 320C are symmetrical to each other with respect to a vertical line and form a polygonal shape, and each have a structure in which a bridge 230C or 330C is disposed to serve as a medium for a current flow between the first electrode 210C or 310C and the second electrode 220C or 320C. It will be apparent that the first electrodes 210C and 310C and the second electrodes 220C and 320C can be implemented in arc shapes. Various modifications each having the bridge 230C or 330C may be present.

Figure 20:
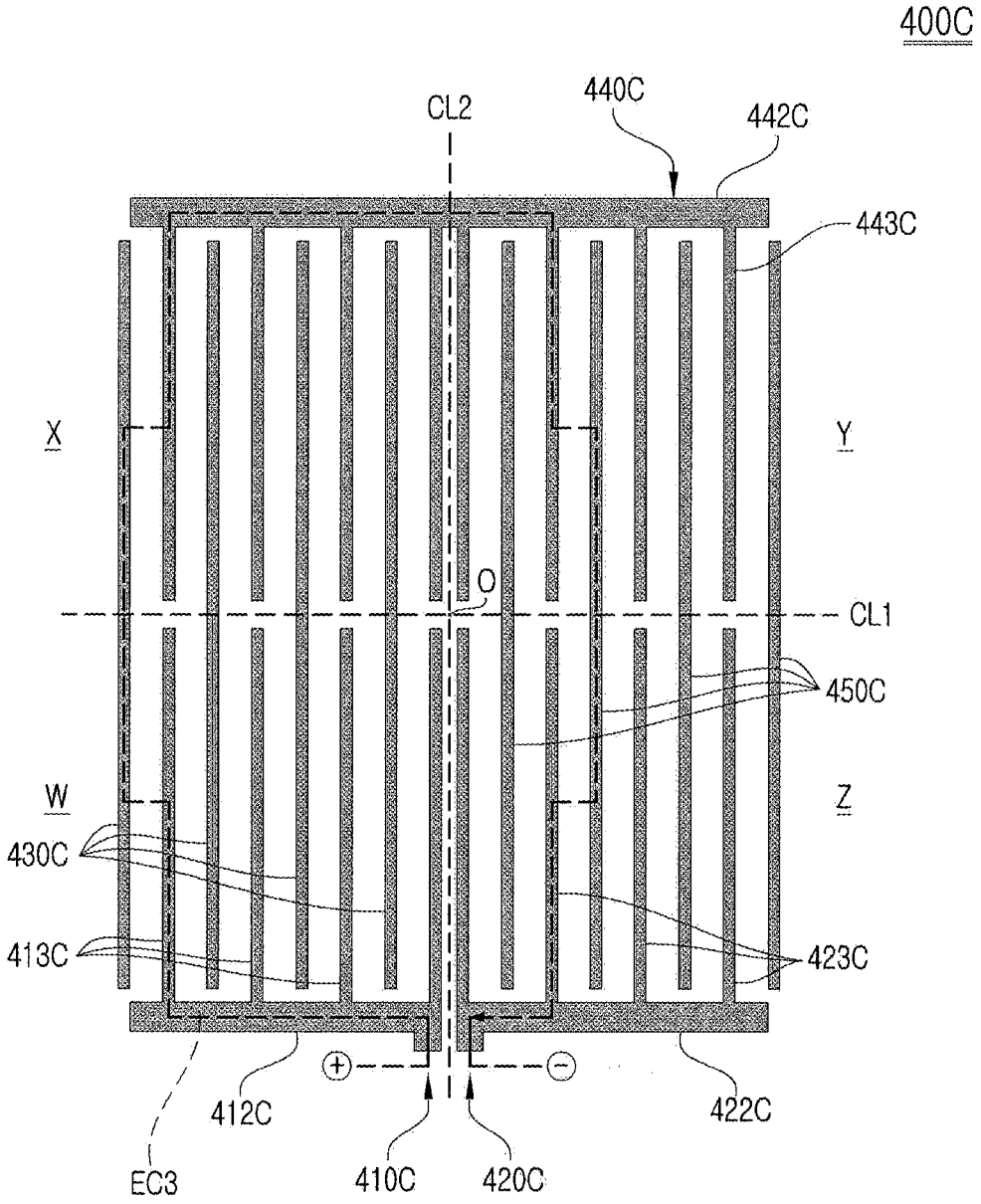
FIG. 20 shows a fourth embodiment of the electrodes of a plane heater according to the third aspect of the present invention.

In a plane heater 400C shown in FIG. 20, a first electrode 410C and a second electrode 420C are symmetrically disposed on the left and right sides of the bottom of the plane heater 400C, and four first bridges 430C, a second bridge 4400, and four third bridges 450C are provided.

Each of the first electrode 410C and the second electrode 420C includes a primary electrode 412C or 422C and branch electrodes 413C or 423C branched off from the primary electrode 412C or 422C. In the present example, the first branch electrodes 413C are provided only in a left first sector W, and the second branch electrodes 423C are provided only in a right fourth sector Z.

In the present example, a heat generation material layer is divided into four sectors W, X, Y and Z by two linear cut regions CL1 and CL2 that pass through a center O and are cut in a cross shape, and thus current flows attributable to the heat generation material between the sectors W, X, Y and Z are blocked.

The first bridges 430C function as paths through which current flows from the first electrode 410C to the second bridge 440C. In other words, when the first electrode is a + pole, current flows from the first sector W to the second sector X through the first bridges 430C.

The second bridge 440C serves as a medium for a current flow between the second sector X and the third sector Y. The second bridge 440C includes a third primary electrode 442C and a plurality of third branch electrodes 443C. Furthermore, the third branch electrodes 443C are alternated with the first branch electrodes 413C in the first sector W, and are alternated with the second branch electrodes 423C in the fourth sector Z.

The third bridges 450C serve as media for current flows between the second bridge 440C and the second electrode 420C. In other words, current flows from the third sector Y to the fourth sector Z through the third bridges 450C.

In an example shown in FIG. 20, when it is assumed that the first electrode 410 is a + pole, current flows in the sequence of the first electrode 410C, the heat generation material, a corresponding one of the first bridges 430C, the heat generation material, the second bridge 440C, the heat generation material, a corresponding one of the third bridges 450C, the heat generation material, and the second electrode 420C (see a dotted line EC3). Since the current flows across the heat generation material four times, resistance is increased. When voltage is constant, more resistance heat is generated as much as the resistance is increased.

Figure 21:
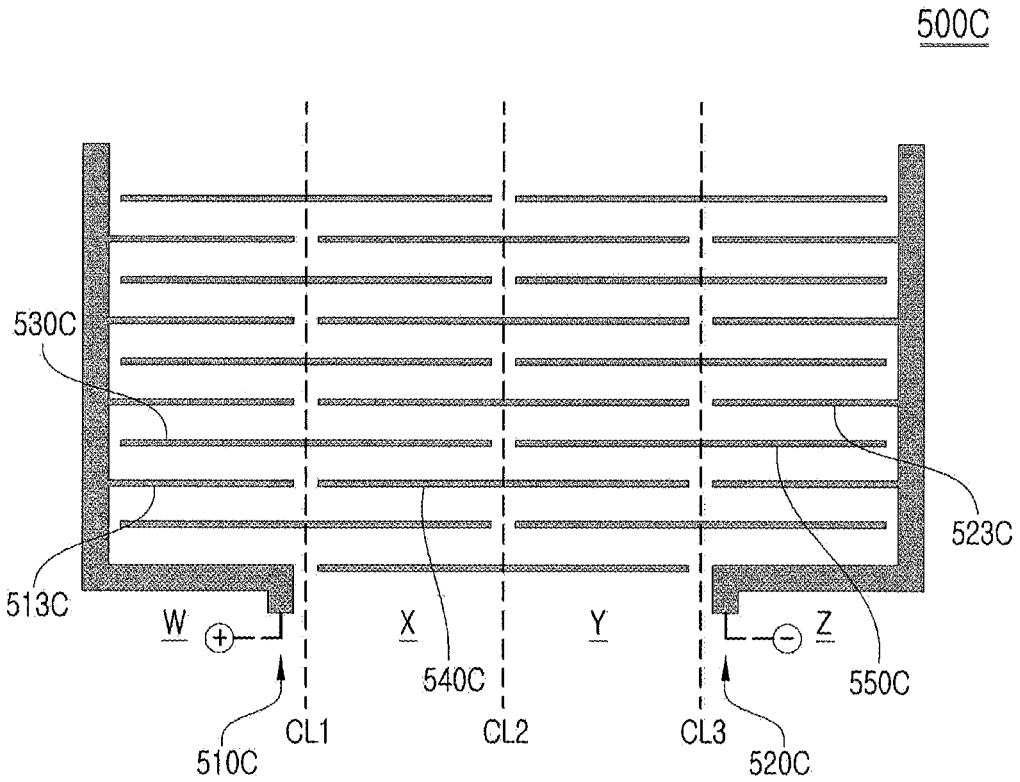
FIG. 21 shows a fifth embodiment of the electrodes of a plane heater according to the third aspect of the present invention.

In the case of a plane heater 500C shown in FIG. 21, a heat generation material layer is cut by three cut lines CL1, CL2 and CL3, and is thus divided into four sectors W, X, Y and Z in a left-right direction. Both electrodes 510C and 520C are divided into left and right sides, the first electrode 510C is disposed in the first sector W, and the second electrode 520C is disposed in the fourth sector Z. It will be apparent that each of both the electrodes 510C and 520C includes a plurality of branch electrodes 513C or 523C. In this example, first bridges 530C serve as media for current flows between the first sector W and the second sector X, second bridges 540C serve as media for current flows between the second sector X and the third sector Y, and third bridges 550C serve as media for current flows between the third sector Y and the fourth sector Z, in the same manner as in the previous embodiments of the third aspect.

According to the third aspect, the amounts of current flowing through all the electric circuits can be made uniform via the bridge 230C, 330C, 430C, 440C, 450C, 530C, 540C or 550C. Furthermore, when input voltage is the same, a design can be made to reduce the amount of current and increase resistance. Accordingly, an overall design area can be reduced by increasing heat generation rate per the same area or increasing the degree of integration.

It will be apparent that the technology according to the third aspect may be combined with the sectional area determination technology according to the above-described first aspect or the interval determination technology according to the above-described second aspect.

As described in conjunction with the plurality of embodiments above, the present invention makes it possible to uniformly generate resistance heat in the heat generation material by making all the theoretically constructed electric circuits have the same resistance. For this purpose, the sectional areas of or the intervals between at least some portions of the first electrode 110A, 210A 310A, 410A, 510A, 610A, 110B, 210B, 310B, 410B, 510B, 110C, 210C or 310C and the second electrode 120A, 220A, 320A, 420A, 520A, 620A, 120B, 220B, 320B, 420B, 520B, 120C, 220C or 320C constituting electric circuits are determined to be different from each other so that the plurality of electric circuit can have the theoretically same resistance.

It will be apparent that it may be taken into account that all electric circuits can be made to generate uniform resistance heat in such a manner that the structures according to the first to third aspects are combined, bridges are constructed in one embodiment, and the sectional areas of or the intervals between at least some portions of the first electrode and the second electrode are determined to be different from each other.

According to the present invention, the following advantages are achieved:

First, the same amount of current flows across all portions between both electrodes as much as possible, and thus resistance heat is uniformly generated in all the portions between both the electrodes, with the result that the utilization of a plane heater can be increased.

Second, a bridge electrode is provided between both electrodes, and thus it is possible to reduce the amount of current flowing through the heat generation material while making the amount of current uniform, with the result that the amount of heat to be generated can be increased or the plane heater can be fabricated in a small size.

Although the present invention has been specifically described in conjunction with the embodiments, the above-described embodiments are intended merely to illustrate examples of the present invention. Accordingly, the present invention should not be construed as being limited only to the embodiments, but the scope of the present invention should be construed as encompassing not only the attached claims but also equivalents to the claims.

What is claimed is:

1. A plane heater comprising:

a nonconductor substrate;

a heat generation material applied to the nonconductor substrate; and a pair of electrodes configured to generate resistance heat in the heat generation material;

wherein the pair of electrodes comprise:

a first electrode connected to one pole of a power source; and a second electrode connected to a remaining pole of the power source;

wherein the first electrode comprises:

a first power input point connected to the one pole of the power source;

a first primary electrode extended from the first power input point; and a plurality of first branch electrodes branched off from the first primary electrode and extended in a direction toward the second electrode, and wherein the second electrode comprises:

a second power input point connected to the remaining pole of the power source;

a second primary electrode extended from the second power input point; and a plurality of second branch electrodes branched off from the second primary electrode and extended in a direction toward the first electrode, and wherein the plurality of first branch electrodes and the plurality of second branch electrodes are alternately arranged, and wherein a sectional area of one of the plurality of first and second branch electrodes is larger than a sectional area of another of the plurality of first and second branch electrodes, the one being farther than the other from the first and second power input points, such that a plurality of electric circuits formed by the first electrode, the heat generation material, and the second electrode have theoretically identical resistance.

2. The plane heater of claim 1, wherein a sectional area of the plurality of first and second branch electrodes is increased in proportion to their distances from power input points at which power is input to the first electrode and the second electrode.

3. The plane heater of claim 2, wherein:

each of the branch electrodes is divided into two twig electrodes;

each adjacent two of the twig electrodes having different poles have an identical sectional area; and of the twig electrodes constituting each of the branch electrodes, the twig electrode farther from the power source input points has a larger sectional area than the twig electrode closer to the power source input points.

4. The plane heater of claim 1, wherein the first or second electrode further comprises a blocking electrode branched off from the first or second primary electrode in order to prevent a direct electric circuit from being formed between the first or second primary electrode and one of the branch electrodes that have opposite poles.

5. The plane heater of claim 1, wherein:

the first branch electrodes and the second branch electrodes are provided in arc shapes, and a sectional area of the branch electrodes is increased in a direction from a center of a circle to an outside thereof.

* * * * *